US005210372A

United States Patent [19]

Tripptrap et al.

[11] Patent Number: 5,210,372

[45] Date of Patent: May 11, 1993

[54] EJECTION DEVICE

[75] Inventors: Peter Tripptrap, Langenfeld; Karl-Heinz Vogt, Essen; Klaus D. Karius, Jüchen, all of Fed. Rep. of Germany

[73] Assignee: Rheinmetall, Düsseldorf, Fed. Rep. of Germany

[21] Appl. No.: 899,843

[22] Filed: Jun. 17, 1992

[30] Foreign Application Priority Data

Jul. 17, 1991 [DE] Fed. Rep. of Germany ..... 4123649

[51] Int. Cl.[5] ..... F42B 12/58

[52] U.S. Cl. ..... 102/489; 102/357

[58] Field of Search ..... 102/340, 342, 351, 357, 102/377, 393, 489, 505

[56] References Cited

U.S. PATENT DOCUMENTS

| | | | |
|---|---|---|---|
| 3,981,244 | 9/1976 | Adimari et al. | 102/489 |
| 4,013,009 | 3/1977 | Claude et al. | 102/340 |
| 4,333,402 | 6/1982 | Landstroom et al. | 102/340 |
| 4,807,533 | 2/1989 | Von Entress-Fursteneck | 102/489 |

FOREIGN PATENT DOCUMENTS

| | | | |
|---|---|---|---|
| 2738031 | 3/1978 | Fed. Rep. of Germany . | |
| 3743840 | 7/1989 | Fed. Rep. of Germany | 102/489 |

*Primary Examiner*—Harold J. Tudor

*Attorney, Agent, or Firm*—Spencer, Frank & Schneider

[57] ABSTRACT

An arrangement for ejecting objects from a projectile, includes a hollow projectile body having a nose end with a plurality of objects disposed in a column within the projectile body. An ejection charge is disposed within the projectile body at the nose end. An ejection device including a hood enclosing a cavity is ejectably disposed within the projectile body between the ejection charge and the column. The hood has a wall with an opening facing the ejection charge so that, after ignition of the ejection charge, resulting powder gases enter into the cavity through the opening to generate a gas pressure between the hood and the adjacent object and simultaneously exert a force on an exterior portion of the wall of the hood that causes the hood and the column to be ejected from the tail end of the projectile body, whereby the hood separates from the column once the hood and column are free of the projectile due to the pressure in the cavity.

4 Claims, 4 Drawing Sheets

EJECTION DEVICE

BACKGROUND OF THE INVENTION

The present invention relates to an arrangement for ejecting objects from a projectile, a dispenser or the like, and more particularly to an arrangement for ejecting objects, for example submunition bodies, from a projectile of the type including a hollow projectile body having a nose end and a tail end, a plurality of objects (e.g. submunition bodies) disposed in a column within the projectile body, an ejection charge disposed within the projectile body at the nose end, and an ejection device including a hood enclosing a cavity and disposed within the projectile body between the ejection charge and an adjacent object of the column, with the hood having a wall with an opening facing the ejection charge so that, after ignition of the ejection charge, powder gases enter into the cavity for exerting a force against the adjacent object for ejecting the column of objects out the tail end of the projectile.

Such an ejection arrangement is disclosed, for example, in German Patent No. 2,738,031.C2, wherein there is provided a hood or cowling, which moves rearward over a short distance relative to the length of the projectile so as to eject the projectile base with the aid of an ejection plate. The ejection of submunition bodies then takes place only by means of the gas charging the ejection plate. The hood remains in the ogival portion of the projectile and throttles the gas stream by means of a channel opening provided in the hood wall.

It is a particular drawback of such prior art ejection devices that the gas stream required to eject the bodies is throttled. Particularly if the submunition bodies are very heavy, such ejection devices cannot be employed. Moreover, these ejection devices are relatively expensive because appropriate means must be provided at the hood and in the ogival portion of the projectile for the relatively short displacement of the hood.

It has been proposed to employ the hood itself to eject the submunition bodies either directly by using the edge of the hood to press onto the adjacent submunition body to be ejected, or indirectly by way of an ejection plate disposed between hood and the adjacent submunition body.

However, the particular drawback of such an ejection arrangement is that, after the ejection process, the hood and the last body ejected from the carrier projectile may easily collide. This danger is particularly great if the carrier projectile is spin stabilized because rotation of the projectile may cause the hood to be discharged in an uncontrolled manner.

SUMMARY OF THE INVENTION

It is therefore an object of the present invention to provide a reliably operating, yet simple arrangement of the above-mentioned type in which the danger of a collision between the submunition bodies to be ejected and the hood does not exist.

The above and other objects are accomplished in accordance with the invention by the provision of an arrangement for ejecting objects from a projectile, comprising: a hollow projectile body having a nose end and a tail end; a plurality of objects disposed in a column within the projectile body; an ejection charge disposed within the projectile body at the nose end; and an ejection device including a hood enclosing a cavity and ejectably disposed within the projectile body between the ejection charge and an adjacent one of the objects of the column, the hood having a wall with an opening facing the ejection charge and communicating with the cavity so that, after ignition of the ejection charge, resulting powder gases enter into the cavity through the opening to generate a gas pressure between the hood and the adjacent object and simultaneously exert a force on an exterior portion of the wall of the hood so as to cause the hood and the column to be ejected from the tail end of the projectile body, whereby the hood separates from the column once the hood and column are free of the projectile due to the pressure in the cavity.

The invention is thus based on the concept of filling, at the beginning of an ejection process, a cavity formed by the hood wall and the adjacent object (e.g. submunition body) or the ejection plate, respectively, with the highly tensioned gases generated during ignition so that, once the ejection process is completed, the hood is axially separated in a controlled manner from the objects by the then remaining internal pressure within the cavity of the hood.

For the case that an ejection plate is employed in addition to the hood, it has been found to be particularly advantageous to connect the ejection plate loosely with the hood, for example, by means of a plug-in connection, so that after the ejection process the two components (hood and ejection plate) come apart. On the other hand, a locking device should initially produce a firm connection between the object adjacent to the ejection device and the ejection plate so that a collision between the ejection plate and the adjacent object cannot occur upon leaving the projectile. Only after the adjacent object has removed itself from the projectile and the spin which was transferred to the adjacent object (assuming a spin stabilized projectile) has been reduced somewhat, can the ejection plate be unlocked from the adjacent object. A collision between ejection plate and adjacent object then need no longer be feared.

Further details and advantages of the invention result from the embodiment to be described below with reference to the drawing figures.

DETAILED DESCRIPTION OF PREFERRED EMBODIMENTS

Figure 1:
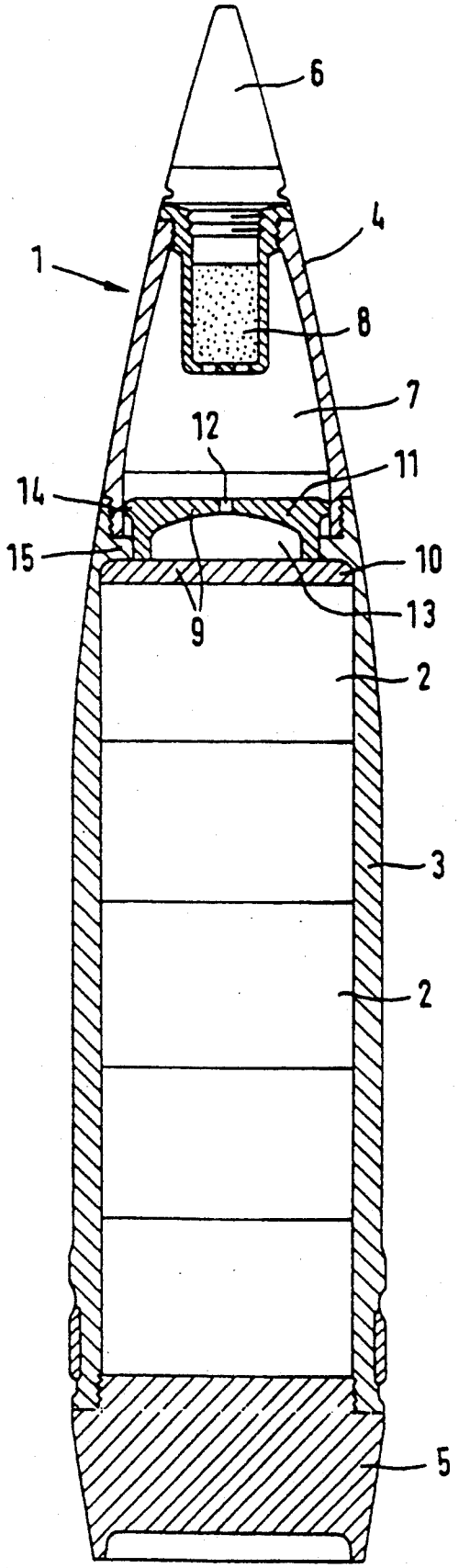
FIG.1 PRIOR ART
FIG. 1 depicts a projectile equipped with a prior art ejection device.

Referring to FIG. 1, there is shown a known carrier projectile arrangement comprising a carrier projectile body 1 in which, for example, five submunition bodies or objects 2 are disposed. Carrier projectile body 1 is composed of an essentially cylindrical housing portion or chamber 3, an ogival housing portion 4 at the nose end of projectile body 1, a bottom 5 at the tail end thereof, and a fuse 6 at the nose end. In a hollow chamber 7 of the ogival housing portion 4 there is disposed an ejection charge 8 connected with fuse 6 and an ejection device 9. The latter is composed of an ejection plate 10 and a hood 11 in the form of a piston. A channel-like opening 12 is disposed in hood 11.

As already described above, hood 11 of this prior art ejection device 9 serves the purpose of performing only a very small movement, relative to the length of the projectile body, in order to effect the ejection of projectile bottom 5. The displacement of hood 11 is here delimited by the abutment of an annular flange 14 provided at the hood on an annular flange 15 on carrier projectile body 1. Thereafter, the highly tensioned gases are throttled through opening 12 in hood 11. This causes ejection plate 11 to be moved relatively slowly toward the projectile tail and thus the submunition bodies to be ejected relatively slowly from the tail end of carrier projectile body 1. During the further ejection process, hood 11 remains in the ogival portion of the housing.

Figure 2:
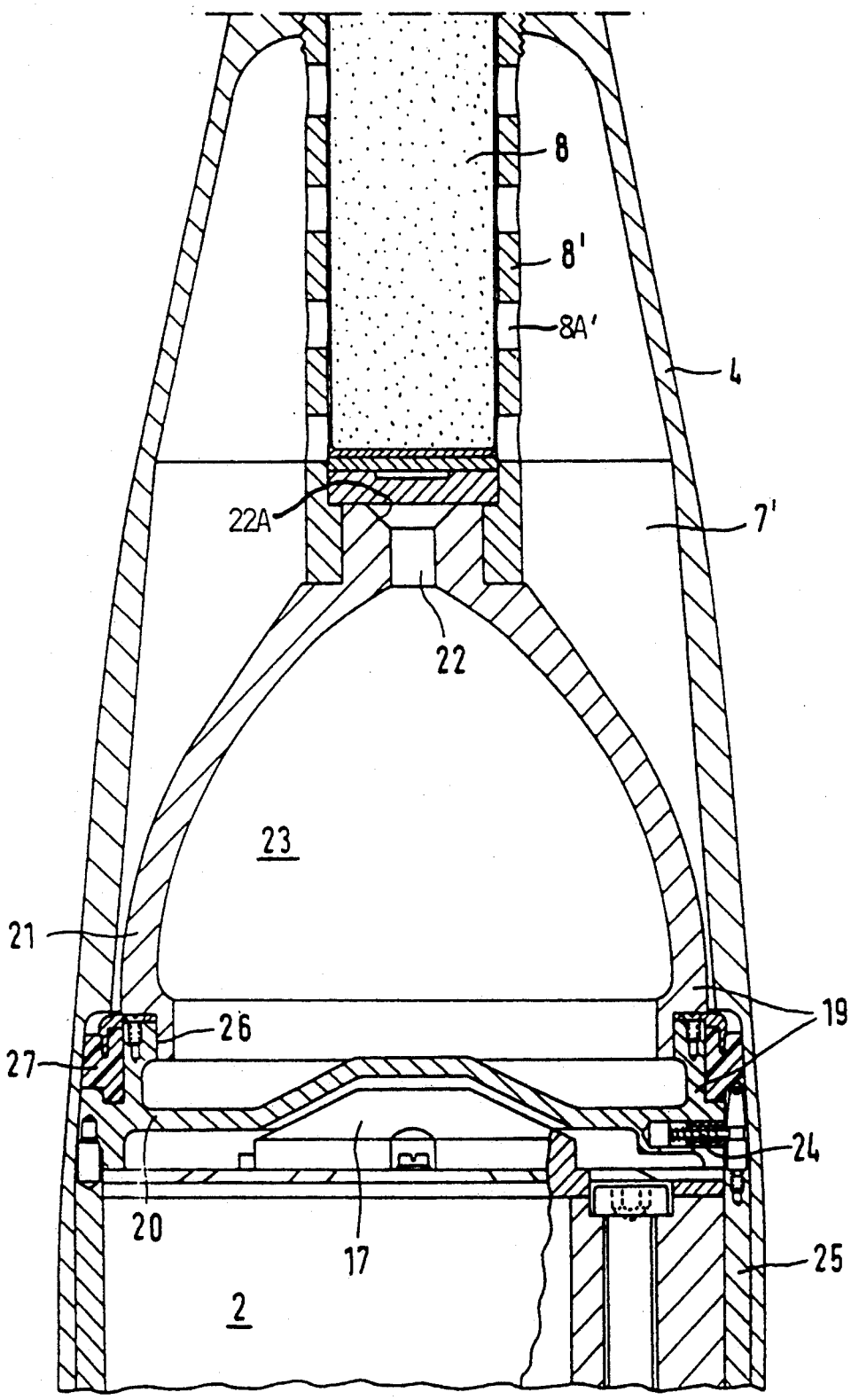
FIG. 2 depicts an ejection device according to the invention.

FIG. 2 shows an ejection device 19 according to the invention for a spin stabilized carrier projectile. This ejection device is also disposed, for example, in the ogival housing portion 4 of carrier projectile body 1. Ejection charge 8 has a housing 8' and is disposed in a gas chamber 7'. For reasons of clarity the fuse is not shown.

Ejection device 19 according to the invention is composed of a bell-shaped hood 21 enclosing a cavity 23 and provided with an opening 22 in its wall or end face adjacent ejection charge 8. An ejection plate 20 is disposed between hood 21 and the adjacent submunition body 2. Hood 21 and ejection plate 20 are releasably connected with one another by way of a plug-in connection 26. The plug-in connection has such dimensions that after the ejection process only an axial separation of the hood from the column is possible. Furthermore, the plug-in connection has such a length that a sufficiently long acceleration path is available to produce a sufficiently high separation velocity of hood and column.

Opening 22 is provided with intake slopes 22A and has such dimensions that a sufficiently large quantity of gas is able to flow into cavity 23 of hood 21 during an ejection process and that, after the ejection process, the pressure reduction within hood 21 will not be too rapid.

In the present embodiment, ejection plate 20 is connected with a casing, 25 of the adjacent submunition body 2 by way of a locking device 24 that is operated by centrifugal forces, for example a slotted steel ring or as in FIG. 2 a spring-mass-system. To seal gas chamber 7' against chamber 3 in which submunition bodies 2 are disposed (see FIG. 2, sealing elements 27 are provided along the circumference of ejection plate 20.

Figure 3:
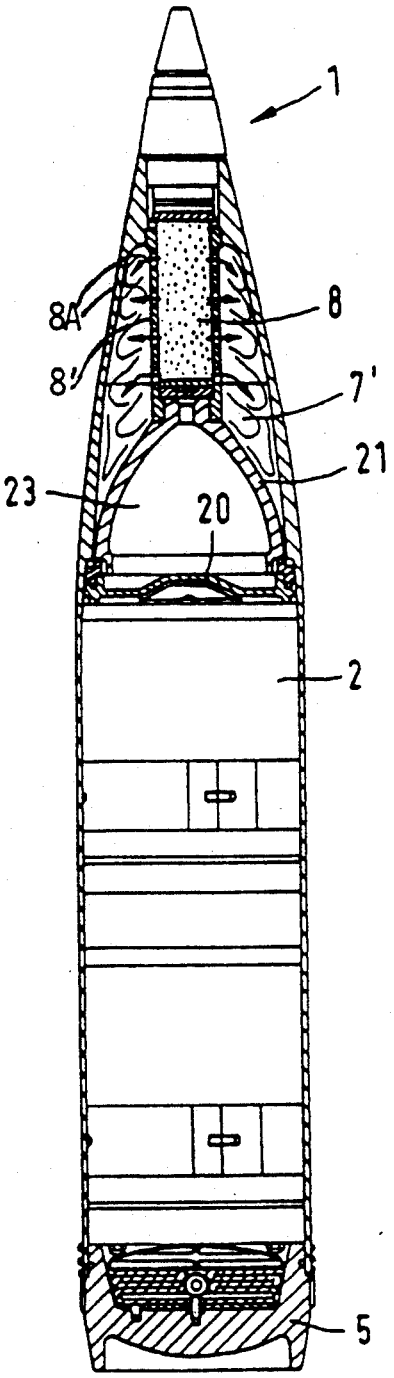
FIGS. 3 to 5 depict a projectile arrangement according to the invention during various phases of the ejection process.
Figure 4:
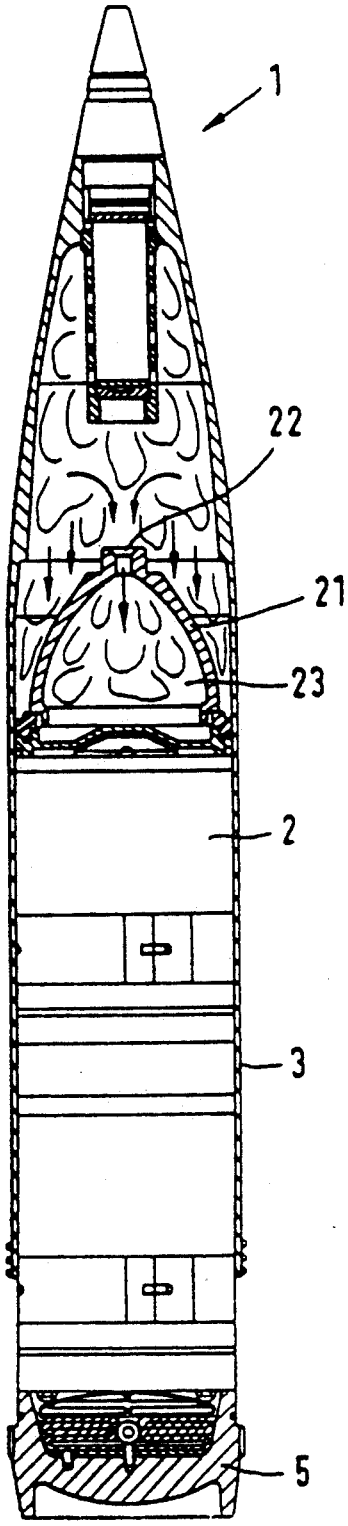
Figure 5:
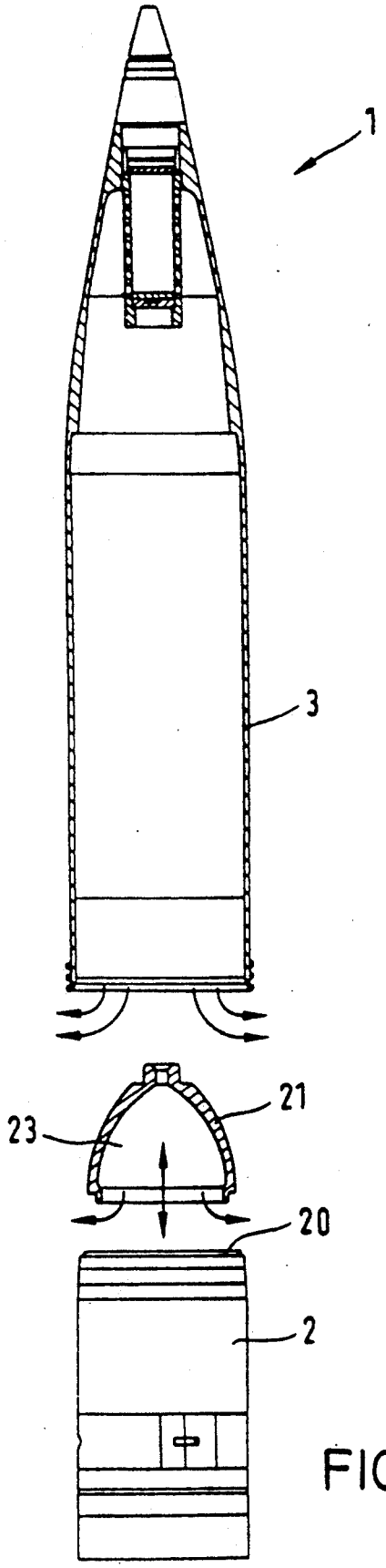

The operation of the invention will now described in somewhat greater detail with reference to FIGS. 3 to 5.

FIG. 3 shows carrier projectile body 1 at the moment when ejection charge 8 is ignited. Powder gases resulting from the ignition penetrate into gas chamber 7' through corresponding openings 8A' of ejection charge housing 8'. Gas pressure acting on the exterior of hood 21 causes the latter to move toward the tail end of projectile body 1 and thus push the entire column composed of projectile bottom 5 and submunition bodies 2 out of housing portion or chamber 3 (see FIG. 4). At the same time, gas enters into cavity 23 through openings 22 in hood 1 so that the pressure increases in this area as well. Once the ejection process is completed, that is, after hood 21 has also been pushed out of projectile body 1, the internal pressure still existing within hood 21 takes care of the axial separation of hood 21 from the column of submunition bodies, with ejection plate 20 remaining attached to the adjacent submunition body 2 (see FIG. 5) for a period of time after which locking 24 is opened, allowing ejection plate to harmlessly separate from the submunition body.

Obviously, numerous and additional modifications and variations of the present invention are possible in light of the above teachings. It is therefore to be understood that within the scope of the appended claims, the invention may be practiced otherwise than as specifically claimed.

What is claimed is:

1. An arrangement for ejecting objects from a projectile, comprising:

a hollow projectile body having a nose end;

a plurality of objects disposed in a column within said projectile body;

an ejection charge disposed within said projectile body at said nose end; and an ejection device including a hood enclosing a hollow cavity and ejectably disposed within said projectile body between said ejection charge and an adjacent object in said column, said hood having a wall with an opening facing said ejection charge and communicating with said hollow cavity so that, after ignition of said ejection charge, resulting powder gases enter into the hollow cavity through the opening to generate a gas pressure between said hood and the adjacent object and simultaneously exert a force on an exterior portion of the wall of the hood that causes the hood and the column to be ejected from the tail end of said projectile body, whereby the hood separates from the column once the hood and column are free of the projectile due to the pressure in the hollow cavity.

2. An arrangement as claimed in claim 1, further comprising an ejection plate disposed within said projectile body between said hood and the adjacent object in said column, and connection means for forming a plug-in connection between said hood and said ejection plate.

3. An arrangement as claimed in claim 2, wherein a region of said projectile body between said ejection charge and said hood constitutes a gas chamber and the column of objects are disposed in a further chamber of said projectile body disposed between said ejection plate and the tail end of said projectile body, and further comprising sealing means disposed in said projectile body at a region of said plug-in connection between said hood and said ejection plate for tightly sealing said further chamber against gas pressure of the powder gases formed in said gas chamber upon ignition of said ejection charge.

4. An arrangement as claimed in claim 3, wherein the region of said plug-in connection traverses a path having such a length that a sufficiently long acceleration path is available to generate a sufficiently high axial separation velocity for said hood and said objects to be separated from said projectile body.

* * * * *